United States Patent [19]

Langon

[11] Patent Number: 4,612,105

[45] Date of Patent: Sep. 16, 1986

[54] CARBONACEOUS ANODE WITH PARTIALLY CONSTRICTED ROUND BARS INTENDED FOR CELLS FOR THE PRODUCTION OF ALUMINIUM BY ELECTROLYSIS

[75] Inventor: Bernard Langon, Saint-Jean-de-Maurienne, France

[73] Assignee: Aluminium Pechiney, Paris, France

[21] Appl. No.: 738,395

[22] Filed: May 28, 1985

[30] Foreign Application Priority Data

May 29, 1984 [FR] France ..... 84 08816

[51] Int. Cl.[4] ..... C25B 11/00; C25C 3/06

[52] U.S. Cl. ..... 204/286; 204/67; 204/294; 373/94; 373/97

[58] Field of Search ..... 204/67, 294, 286, 288; 373/81, 94, 92, 97–101

[56] References Cited

U.S. PATENT DOCUMENTS 3,236,753 2/1966 Skantze ..... 204/294

4,376,690 3/1983 Kugler ..... 204/294

4,526,669 7/1985 Joo ..... 204/294

*Primary Examiner*—John F. Niebling

*Attorney, Agent, or Firm*—Dennison, Meserole, Pollack & Scheiner

[57] ABSTRACT

The invention relates to a carbonaceous anode intended for cells for the production of aluminium by igneous electrolysis according to the Hall-Heroult process, which is connected to the positive current input by at least one steel conductor comprising a lower portion which penetrates into the carbonaceous anode and an upper portion which is connected to the positive current input. The upper portion of the steel conductor has, over at least 30% of the length of the upper portion, a cross sectional area which is at most equal to 60% of the cross sectional area of the lower portion.

The upper portion may be constituted by a solid profile of reduced cross section or a tubular profile.

The invention can be applied to prebaked anodes and to Soderberg anodes. It allows a substantial gain over the voltage drop in the anodic system.

9 Claims, 6 Drawing Figures

CARBONACEOUS ANODE WITH PARTIALLY CONSTRICTED ROUND BARS INTENDED FOR CELLS FOR THE PRODUCTION OF ALUMINIUM BY ELECTROLYSIS

The present invention relates to a carbonaceous anode with partially constricted round bars intended for cells for the production of aluminium by electrolysis.

The essential object is to allow a reduction in the drops due to the resistance at the connection of the anodic carbon while reducing the thermal losses through the anodic system of these cells and increasing the service life of the aluminium-steel connections. It is particularly suitable for electrolysis cells containing pre-baked anodes, but it can be used for so-called Soderberg electrolysis cells having continuous anodes.

The aluminium is produced essentially by electrolysis of alumina dissolved in a cryolite-containing bath. The electrolysis furnace which allows this operation is constituted by a carbon cathode placed in a steel container and lagged with refractory insulating products, the carbon cathode being surmounted by a carbon anode or a plurality of carbon anodes dipping into the cryolite-containing bath which is gradually oxidized by the oxygen originating from the decomposition of the alumina.

A current is passed through from top to bottom. The cryolite is maintained in the liquid state by the JouIe effect, at a temperature close to it solidification temperature. The usual temperatures for operation of the cells are between 930° and 980° C. The aluminium produced is therefore liquid and is deposited by gravity on the sealed cathode. The aluminium produced or a proportion of the aluminium produced is regularly sucked, by a casting ladle and decanted into the foundry furnaces and the spent anodes are replaced by new anodes The operating intensities of these electrolyzing apparatuses are between 100,000 and 300,000 amperes nowadays. The current connecting and distributing conductors are therefore made of industrial metals of hioh electrical conductivity, that it to say pure or alloyed copper and aluminium.

STATEMENT OF THE PROBLEM

The carbonaceous portions of the electrolyzing apparatuses are at temperatures close to the temperatures of the cryolite-containing bath. The connection of the anode and the cathode to the current conveying conductors is therefore necessarily made by means of an intermediate portion which is resistant to these high temperatures. This intermediate portion is usually made of steel. The assemby used comprises several elements:

(a) a connecting element between the conductor and the steel. This may be a mere push contact, a contact which is improved by various means (conductive lubricants, grinding, tin plate, clamping, etc.), a bimetallic or trimetallic compound plated by co-rolling, explosion, pressing, friction such as copper-iron, aluminium-iron, aluminium-titanium-iron, etc.

(b) a conductive steel portion penetrating into the carbon. This may be designed in the form of round bars, plates, rods of square, rectangular or profiled cross-section.

(c) a connecting element between the steel portion and the anodic or cathodic carbon. This element may be a cast iron, carbon, carbonaceous paste or dry seal.

The steel portion and the connecting elements are at a temperature which decreases from the carbon towards the copper or aluminium conductor. They therefore support a considerable thermal flux, representing a significant loss of power in the electrolysis process.

It is very difficult to reduce the thermal losses by conventional insulation processes. In fact, if the steel portion is insulated, its temperature will rise excessively and will lead to irreversible deterioration of the connection between the conductor and the steel or even to deterioration of the aluminium or copper conductor. There is a risk of the deterioration of these elements causing a break in the electrical continuity and therefore a partial or total stoppage of electrolysis.

To reduce this thermal flux by conduction, one might consider reducing the cross-section of this portion of steel conductor. In this case, the person skilled in the art would encounter three obstacles:

(i) by reducing the cross-section of the steel, the drop due to the resistance in the steel is increased and this compromises the object of reducing the power consumption of the electrolysing apparatus.

(ii) by reducing the cross-section of the steel, the temperature and, correlatively, the thermal losses by convection and radiation of the steel in the portion in the open air is increased. The gain allowed for in the transfer of heat by mere conduction is thus greatly attenuated. Moreover, the connection between steel and aluminium or copper conductor, which is brittle at high temperature, deteriorates.

(iii) by reducing the cross-section of the steel, the connection between steel and carbon has a lower performance and the loss of power by the drop in contact resistance at this point further reduces the gains allowed for.

Consequently, the operation is generally translated by a deterioration in the connection between steel and aluminium or copper without a significant gain in the power consumption.

To solve this problem, it is not sufficient to transfer the solutions proposed in the patents FR 2,088,263 (Alusuisse) and FR 1,125,949 (PECHINEY) in the case of cathodic rods because the majority of the cathodic rods are immersed in cathodic blocks and the lateral linings, whereas the round anode bars are exposed to the open air over almost their entire length except for the portion which is sealed in the anode and directly above the anode. The conditions of thermal equilibrium are therefore very different.

The steel-carbon electrical connecting element which operates at temperatures higher than 700° introduces into the passage of the current a very high parasistic resistance constituted by a contact resistance and a local resistance in the carbon of the anode where the passage of the current is highly concentrated around the seal. Measured in the present conditions of connection, it reaches 30 to 50% of the total resistance of the anode. Numerous processes have been adopted in order to reduce this contact resistance. An effective method involves increasing the contact surface by increasing the number or size of the housings provided in the anode for accommodating the steel conductors. Unfortunately, it has an undesirable consequence: if the number and size of the steel conductors are increased, the conductive thermal flux traversing these elements increases in proportion with the cross-sections. The thermal equilibrium of the electrolysis cell is therefore disturbed and it is necessary to balance the power. The overall balance is unfavourable as the increase in the heat losses is higher than the gain in resistance obtained at the anodic connection.

OBJECT OF THE INVENTION

The object of the present invention is to reduce the contact resistance at the connection of the carbonaceous anodes of aluminium electrolysis cells without increasing the thermal losses of the electrolysis cell through the steel conductors penetrating into the carbonaceous anode.

In particular, the invention relates to a carbonaceous anode designed for cells for the production of aluminium by igneous electrolysis in accordance with the Hall-Heroult process, of which the connection to the positive current intake is provided by at least, one steel conductor comprising a lower portion which penetrates into the carbonaceous anode and an upper portion connected to the positive current intake, characterised in that the upper portion of the steel conductor has, over at least 30% of the length of its upper portion, a cross-section which is equal to at most 60% of the cross section of the lower portion.

Depending on the type of anode under consideration—prebaked or Soderberg—the steel conductor is a round bar which is sealed by a known process such as casting in a recess made in the upper portion of the prebaked anode or a pin of which the lower end is reduced and which is introduced by force into the Soderberg carbonaceous paste.

BRIEF DESCRIPTION OF THE DRAWINGS

FIG. 1 shows the distribution of the temperature over a round anode bar which is partially constricted, according to the invention.

FIG. 2 shows the distribution of the temperature over a round anode bar according to the prior art by way of comparison.

FIGS. 3 to 5 show by way of non-limiting examples various embodiments of the invention on so-called prebaked anodes.

FIG. 6 shows by way of non limiting examples two embodiments of the invention on so-called Soderberg continuous anodes.

In FIG. 1, the prebaked anode 1 comprises, in conventional manner, a cavity 2 in which the round bar 3 is sealed, usually by casting 4. The section of the round bar 3 is locally reduced 5. It is known that, in cells having prebaked anodes 1, approximately half of the thermal flux traversing the anodes is discharged through the steel. The method of heat transmission is essentially mere conduction. The dotted line XX' represents the boundary between the lower portion of the conductor which is sealed in the carbon and the upper portion.

Figure 1:
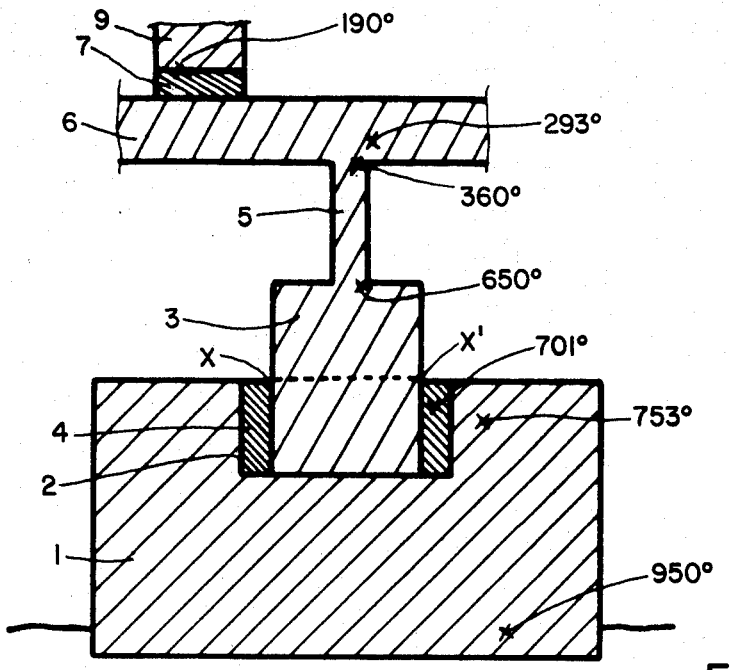
FIGS. 1 to 6 shown an embodiment of The invention. They are illustrations of a vertical section.

In the case illustrated in FIG. 1, which relates to the invention, it has been found that a partial reduction of the cross-section of steel in the upper portion allowed high temperature gradients to be obtained locally. This enables the hot zones and the cold zones in the steel to be located precisely. In the test illustrated in FIG. 1, a temperature drop from 650° C. to 320° C. is obtained over a length of 10 cm.

Figure 2:
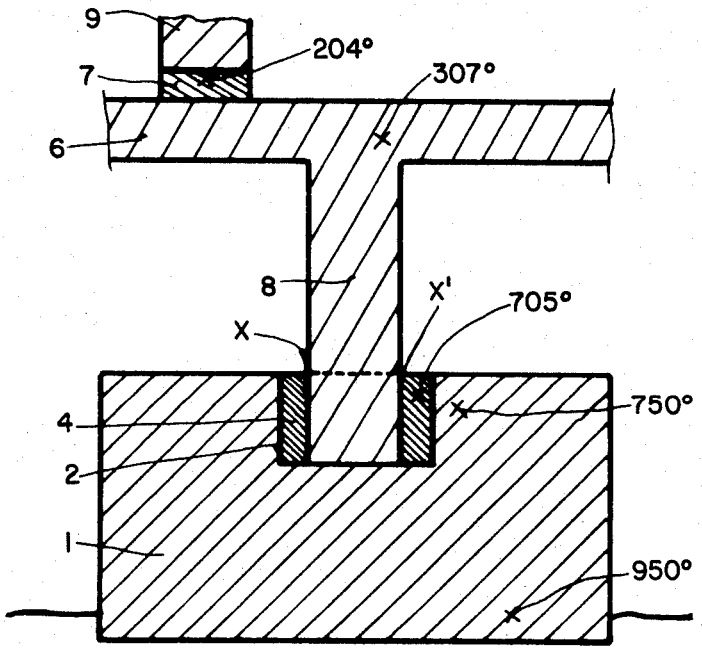
FIG.2 PRIOR ART

FIG. 2 shows how, according to the prior art and under identical conditions, temperatures are established in the anodic system when the round bar 8 has a constant cross-section.

It has also been found that the current density would be increased locally without the occurrence of the fuse effect well known to a person skilled in the art. In fact, the proximity of a significant mass of steel at relatively low temperature rapidly absorbs the calories released by the Joule effect if the intensity increases excessively in the round bar 3.

FIG. 1 therefore shows that the rise in the temperature of the steel, the source of thermal losses by convection and radiation, is localised just above the anode. It will therefore be sufficient to insulate this zone using conventional thermal insulators such alumina, or a crushed electrolysis bath, or carbonaceous paste granulates to elminate the majority of the thermal losses produced therein, while the central and upper portions of the round bar and its connections 6, 7 to the conductors 9 can easily be left in the open air owing to their moderate temperature of the order of 300° C. or lower.

The increased drop due to the in resistance in the constricted portion 5 may be compensated, and even more than compensated, by an increase in the cross section of the hot portion of the steel where the electrical resistivity is high. The temperature coefficient of the electrical resistivity of the iron is, in fact, 0.0147 at 500° C., this being an exceptionally high value for metals, and it is at a maximum at about 500° C.

Furthermore, the contact between steel and the carbon is improved by the increase in the cross section of the lower steel portion 3 dipping into the carbon and by the rise in temperature in this zone and by the fact that the additional thermal expansion of the metallic portion helps to improve this contact. The gain in contact resistance thus obtained is almost 30% relative to the assembly according to the prior art (FIG. 2).

The choice of the dimensions of the constricted and unconstricted portions of the round bar is not random. The sections and lengths of these two portions must be such that the total thermal resistance obtained is equal to or preferably slightly greater than that of the assembly according to the prior art, and can easily be calculated by a person skilled in the art. This implies that the length of the constricted portion 5 increases as its cross sectional area approaches that of the original round bar. This also implies a relationship between the length of the portion 5, the cross sectional area of the portion 5 and the cross sectional area of the portion 3.

It has been found that the invention is particularly effective if the ratio between the cross sectional area of the zone 5 and the cross sectional area of the zone 3 is equal to or less than 0.6. The length of the reduced portion should be equal to at least 35% of the total length of the upper portion of the round bar.

This allows the total thermal resistance to be balanced without reaching the fusibility effect while obtaining a improvement gain in the contact resistance greater than 30% of its starting value in all cases.

EMBODIMENT OF THE INVENTION

Starting from the basic principle defined above, there are several possible embodiments.

Figure 3:
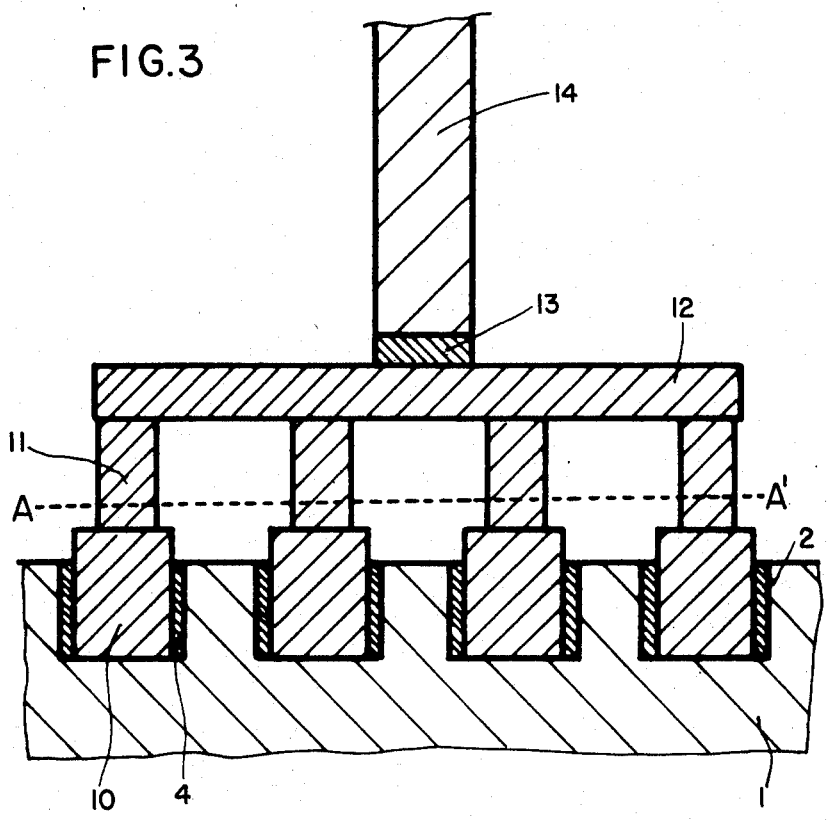

In FIG. 3, the anode 1 comprises 4 sealing orifices 2. Each round bar comprises a lower portion 10 having a height of 200 mm and a diameter of 150 mm, which is sealed by casting 4 in the anode and, over a height of 170 mm, the upper portion 11 has its cross sectional area reduced to 36% of the cross sectional area of the lower portion (90 mm in diameter).

The four round bars 11 are connected by a rectangular cross beam 12 of large section (150×80 mm) which, in turn, is connected by an aluminium-iron clad 13 to the aluminium rod 14 which provides the electrical connection to the anodic bus bar (not shown).

The hot zone is insulated by an alumina or crushed bath covering up to the approximate level indicated by the dotted line AA' (2 to 3 centimeters above the connection with the constricted portion of the round bar).

Use of this assembly in a prototype 280,000 ampere cell has demonstrated that it is sufficient to cover the large section round bar with a few centimetres of alumina in order to insulate the anodes very strongly. The current densities used in this case were:

cross beam (12) (cold zone): 15 A/cm$^2$
round bar (constricted zone 11): 28 A/cm$^2$
(hot zone 10): 10 A/cm$^2$ By operating this 280,000 A cell with prior art round anode bars having a constant diameter of 120 mm with anodes provided according to the invention, a gain of 30 mV appears in the anodic drop. This is translated by a reduction in the power consumption of the cell of 100 Kwh/T, and it has been possible to reduce the operating voltage of the electrolyzing apparatus by 0.03 volts without a change in intensity. In fact, the total thermal resistance of the round bar and of its constricted portion is higher by 50% than the thermal resistance of the round bar having a diameter of 120, in this case. This allows additional insulation of the cell which enables the power injected into the cell to be lowered.

Figure 4:
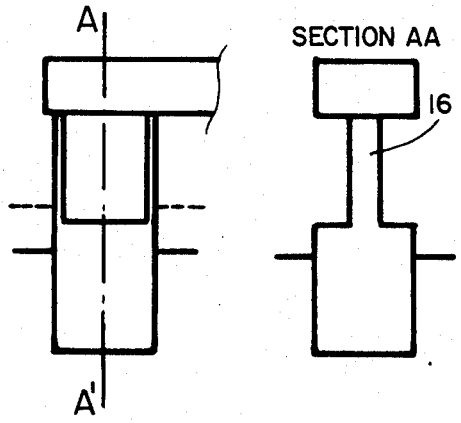

In a further embodiment of the invention (FIG. 4) the constricted portion 11 of the round bar has been formed by a tube 15 having the advantage of improved dissipation of heat by radiation in the case of excessive overcharging, with an equal current density. For example, it can have an external diameter of 150 mm and an internal diameter of 120 mm with a height of 150 mm. An assembly of this type can be obtained by electric welding of these components, but also by moulding since the large number of elements required in a series of one or several hundreds of electrolysis cells each comprising several tens of anodes easily absorbs the cost of the moulds.

Figure 5:
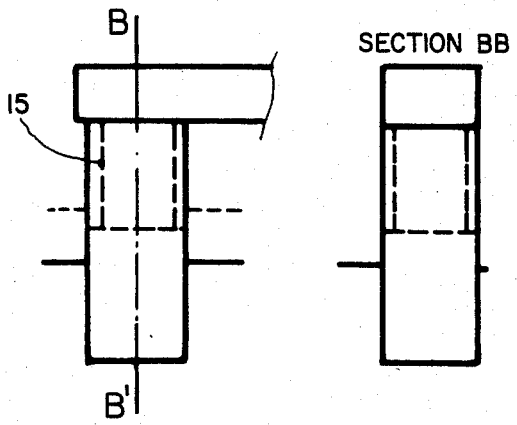

Another possibility involves sawing the upper portion of the round bar (FIG. 5) so as to reduce it to a rectangular plate 16 of which the cross sectional area represents no more than, for example, 40% of the starting cross sectional area.

Figure 6:
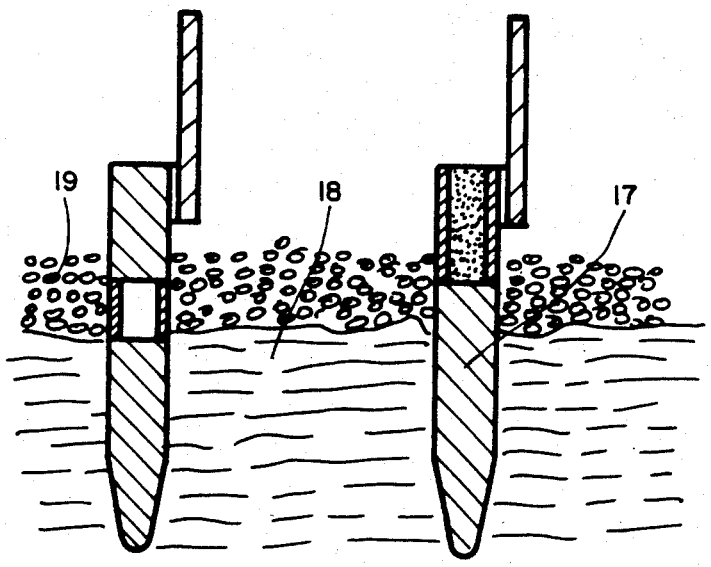

Finally, in the case of Soderberg anodes (FIG. 6) the current is introduced through steel rounds known as "pins", 17 which are placed directly in the carbonaceous paste 18 and which are removed then placed slightly higher up as the anode wears away through combustion so as to prevent the lower point of the pin from coming into contact with the electrolyte. As with the prebaked round anode bars, the diameter of the upper portion of the pin (which is often about 100 to 150 mm) can be reduced below the zone of contact of the pin in the anodic bus bar and the diameter of the lower portion can be increased. In this case, the upper portion of the anode is insulated by carbonaceous paste granulates 19 which are added periodically so as to reconstitute the anode as it is used up at the lower portion. To allow the pin to be extracted from the paste in a simple manner, the assembly employing a tube having the same external diameter as the lower portion is preferred.

Implementation of the invention allows a gain of the order of 200 to 300 kwh/T of aluminium to be obtained and allows a considerable increase in the service life of the aluminium-steel clads which will be at least equal to that of the actual steel elements.

I claim:

1. In a carbonaceous anode for a cell for the production of aluminum by igneous electrolysis according to the Hall-Heroult process, said anode including at least one steel conductor having a lower portion penetrating into said anode, with said steel in conductive contact with said carbonaceous anode, and an upper portion adapted to be connected to a positive terminal of a source of current for the cell, the improvement wherein said upper portion comprises a longitudinal portion of reduced cross sectional area, the length of said longitudinal portion being at least 30% of the length of said upper portion and the cross sectional area of said longitudinal portion being at most equal to 60% of the cross sectional area of said lower portion.

2. A carbonaceous anode according to claim 1, comprising a baked anode wherein the steel conductor is a round bar which is sealed in a cavity in the upper portion of the baked anode.

3. A carbonaceous anode according to claim 1, comprising a Soderberg anode wherein the steel conductor is a pin of which the lower end is pointed and which is forcibly introduced into carbonaceous paste forming the said anode.

4. A carbonaceous anode according to any one of claims 1, 2 or 3, wherein the upper portion of the steel conductor of reduced cross sectional area is of solid construction.

5. A carbonaceous anode according to any one of claims 1, 2 or 3, wherein the upper portion of the steel conductor of reduced cross sectional area is of tubular construction.

6. A carbonaceous anode according to claim 2, wherein the anode is defined by a block of carbonaceous paste baked at high temperature and provided in its upper portion with at least one sealing orifice, with the lower portion of the steel conductor sealed by casting into the sealing orifice, said casting having a height at least equal to the depth of the sealing orifice.

7. A carbonaceous anode according to any one of claims 2, 3 and 6, and a covering, up to a level at least equal to the height of the lower portion of the steel conductor, of an insulating substance selected from the group comprising alumina, solidified and crushed cryolite-containing electrolysis bath, granulated carbonaceous paste and admixtures thereof.

8. A carbonaceous anode according to claim 4, and a covering, up to a level at least equal to the height of the lower portion of the steel conductor, of an insulating substance selected from the group comprising alumina, solidified and crushed cryolite-containing electrolysis bath, granulated carbonaceous paste and admixtures thereof.

9. A carbonaceous anode according to claim 5, and a covering, up to a level at least equal to the height of the lower portion of the steel conductor, of an insulating substance selected from the group comprising alumina, solidified and crushed cryolite-containing electrolysis bath, granulated carbonaceous paste and admixtures thereof.

* * * * *